US006079648A

United States Patent [19]

Eastman et al.

[11] Patent Number: 6,079,648

[45] Date of Patent: Jun. 27, 2000

[54] ARRANGEMENT FOR SECURING A VANE WHEEL ASSEMBLY TO A GRINDING TABLE OF A PULVERIZING BOWL MILL

[75] Inventors: Rory G. Eastman; Lawrence S. Farris, both of East Granby; Robert S. Prairie, Vernon, all of Conn.

[73] Assignee: Combustion Engineering, Inc., Windsor, Conn.

[21] Appl. No.: 09/260,584

[22] Filed: Mar. 1, 1999

[51] Int. Cl.[7] ..... B02C 15/04

[52] U.S. Cl. ..... 241/119

[58] Field of Search ..... 241/117–121

[56] References Cited

U.S. PATENT DOCUMENTS

| | | | |
|---|---|---|---|
| 5,020,734 | 6/1991 | Novotny et al. | 241/119 |
| 5,127,590 | 7/1992 | Bunton | 241/119 |
| 5,340,041 | 8/1994 | Henning et al. | 241/119 |
| 5,549,251 | 8/1996 | Provost | 241/119 |

*Primary Examiner*—Mark Rosenbaum
*Attorney, Agent, or Firm*—Russell W. Warnock

[57] ABSTRACT

An arrangement for supporting a vane wheel assembly of a pulverizer bowl mill that is operative to effect therewith a reliable and accurate securement of a vane wheel assembly to the rotating grinding table of the pulverizer bowl mill.

4 Claims, 5 Drawing Sheets

ARRANGEMENT FOR SECURING A VANE WHEEL ASSEMBLY TO A GRINDING TABLE OF A PULVERIZING BOWL MILL

BACKGROUND OF THE INVENTION

The present invention relates to a pulverizer bowl mill and, more specifically, to an arrangement for supporting a vane wheel assembly of a pulverizer bowl mill.

It has long been known in the prior art to provide apparatus that is suitable for employment for purposes of effecting the grinding, i.e., pulverization, of materials, with coal being one such material. More specifically, the prior art is replete with examples of various types of apparatus that had been used heretofore to effect therewith the grinding of a multiplicity of different kinds of materials. In this regard, in many instances discernible differences of a structural nature can be found to exist between individual ones of the aforesaid apparatus. The existence of such differences is in turn attributable for the most part to the diverse functional requirements that are associated with the individual applications in which such apparatus are designed to be employed. For instance, in the selection of the particular type of apparatus that is to be utilized for a specific application one of the principal factors to which consideration must be given is that of the nature of the material that is to be ground in the apparatus.

One particular type of coal pulverizing apparatus, which is to be found in the prior art is an apparatus, most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl. Reference may be had by way of exemplification to U.S. Pat. No. 3,465,971, which issued Sep. 9, 1969 to J. F. Dalenberg et al., and/or U.S. Pat. No. 4,002,299, which issued Jan. 11, 1977 to C. J. Skalka, both of the latter patents having been assigned to the same assignee as the instant application, for a teaching of the nature of the construction and the mode of operation of a prior art form of bowl mill that is suitable for use in a coal fired power generation system to effectuate the pulverization of the coal that is to be burned as fuel therein.

Continuing, in a coal pulverizing apparatus of the type to which reference has been had hereinbefore, a primary classification is had within the bowl mill of the material, e.g., coal, that is being pulverized therewithin. As employed herein the term primary classification is intended to refer to the separation of pulverized material from the air in which such material is entrained. In particular, reference is had here to that separation of pulverized material, which occurs as a consequence of causing the air within which the pulverized material is entrained to follow a tortuous path through the bowl mill whereby in the course of changing directions of flow the larger of the particles of the pulverized material lose their momentum and are made to return to the surface of the grinding table whereat they are subjected to further pulverization.

In accordance with the teachings of the prior art, it has been known to employ a vane wheel assembly in a bowl mill for purposes of accomplishing the aforedescribed primary classification of pulverized material therewithin. By way of exemplification, such a bowl mill comprises the subject matter of U.S. Pat. No. 4,523,721, which issued on Jun. 18, 1985 to T. V. Maliszewski et al. and which is assigned to the same assignee as the present invention.

Efforts to rigidly secure a vane wheel assembly to the grinding table of a bowl mill for rotation therewith had led to problems such as cracking due to differential thermal expansion. Accordingly, there remains a need in the prior art for an arrangement that reliably and accurately secures a vane wheel assembly to a rotating grinding table of a bowl mill yet which improves over the prior art.

It is an object of the present invention to provide an arrangement for securing a vane wheel assembly to the rotating grinding table of a bowl mill in a reliable manner.

SUMMARY OF THE INVETION

In accordance with the present invention there is provided an arrangement for securing a vane wheel assembly to a grinding table of a bowl mill, wherein the vane wheel assembly includes a plurality of vanes mounted to at least one shroud sub-assembly at circumferential spacings from one another. The subject arrangement comprises first securement means securable with the bowl mill, and second securement means securable with the shroud sub-assembly. The first securement means and the second securement means cooperate together to retain the shroud sub-assembly in a retained relationship with the bowl mill for rotation of the vanes with the grinding table during rotation of the grinding table. In addition, the first securement means and the second securement means also movably engage one another in a manner permitting free movement in a predetermined direction of at least a portion of the inner shroud sub-assembly relative to the grinding table while the inner shroud sub-assembly is in its retained relationship with the grinding table.

DESCRIPTION OF A PREFERRED EMBODIMENT

Figure 1:
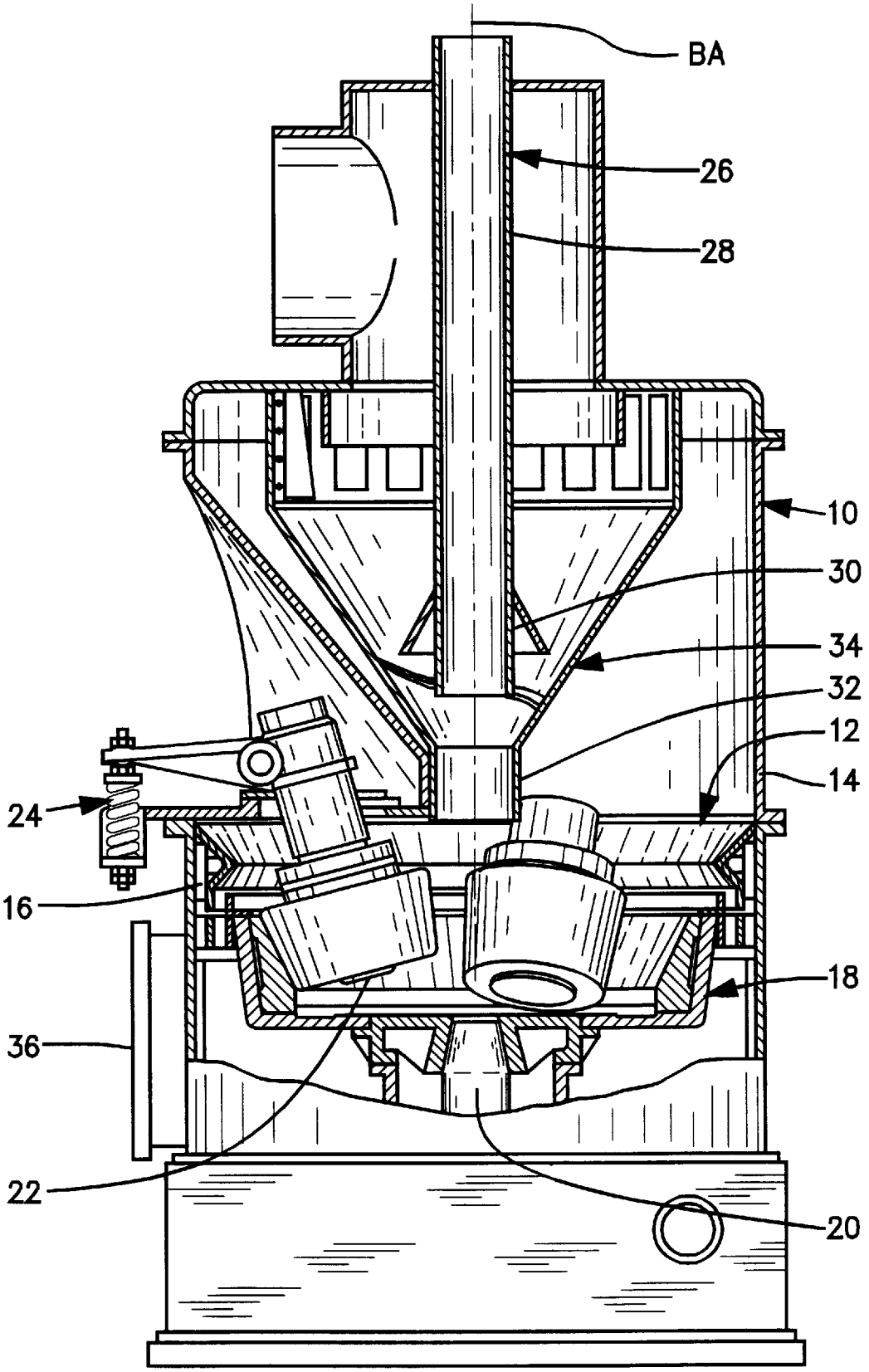
FIG. 1 is a front view in vertical section of a pulverizer bowl mill.

Referring FIG. 1 of the drawings, a bowl mill 10 as illustrated therein includes a vane wheel assembly 12 and a substantially closed body portion comprised of a separator body 14 and a millside area 16. A grinding table 18 is mounted on a shaft 20, which in turn is operatively connected to a suitable drive mechanism (not shown) so as to be capable of being rotatably driven thereby. With the aforesaid components arranged within the closed body portion in the manner depicted in FIG. 1, the grinding table 18 is designed to be driven in a clockwise direction about a bowl mill axis BA defined by the axis of the shaft 20.

Continuing with a description of the bowl mill 10, a plurality of grinding rolls 22, preferably three in number in accord with conventional practice, are suitably supported within the interior of the separator body 14 so as to be equidistantly spaced one from another around the circumference of the closed body portion. In the interest of maintaining clarity of illustration in the drawing, only two such grinding rolls 22 have been shown. With further regard to the grinding rolls 22, each is preferably supported on a shaft 24, which in turn is cooperatively associated with some form of biasing means.

The material, e.g. coal, that is to be pulverized in the bowl mill 10 is fed thereto by means of any suitable conventional form of feed means. By way of exemplification in this regard one such feed means that may be employed for this purpose is a belt feeder means (not shown). Upon being discharged from the feed means (not shown), the coal enters the bowl mill 10 by means of a coal supply means, generally designated by reference numeral 26, with which the closed body portion is suitably provided. In accordance with the embodiment of the bowl mill 10 illustrated in FIG. 1, the coal supply means 26 includes a suitably dimensioned duct 28 having one end thereof which extends outwardly of the closed body portion and preferably terminates in a funnel-like member (not shown). The latter member (not shown) is suitably shaped so as to facilitate the collection of the coal particles entering the bowl mill 10, and the guiding thereafter of these coal particles into the duct 28. The other end 30 of the duct 28 of the coal supply means 26 is operative to effect the discharge of coal onto the surface of the grinding table 16. To this end, as shown in FIG. 1, the duct end 30 preferably is suitably supported within the closed body portion through the use of any suitable form of conventional support means (not shown) such that the duct end 30 is coaxially aligned with the shaft 18 that supports the grinding table 16 for rotation, and is located in spaced relation to a suitable outlet 32 provided in the classifier, generally designated by reference numeral 34, through which the coal flows in the course of being fed onto the surface of the grinding table 16.

In accord with the mode of operation of bowl mills that embody the form of construction depicted in FIG. 1, a gas such as air is utilized to effect the conveyance of the coal from the grinding table 18 through the interior of the closed body portion for discharge from the bowl mill 10. The air that is used in this connection enters the miliside area 16 through a suitable opening, denoted by the reference numeral 36, formed therein for this purpose. From the aforesaid opening 36 in the millside area 16 the air flows in surrounding relation from beneath the grinding table 18 to above the surface of the latter. More specifically, the air flows through the space, identified by the reference numeral 38, provided for this purpose between the inner wall surface of the millside area 16 and the circumference of the grinding table 18. The path of flow that the air follows thereafter will be described more fully hereinafter in connection with the description of the vane wheel assembly 12 with which the bowl mill 10 in accord with the present invention is provided.

The air is made to flow through the interior of the bowl mill 10 and the coal which is disposed on the surface of the grinding table 18 is being pulverized by the action of the grinding rolls 22. As the coal becomes pulverized, the particles that result therefrom are thrown outwardly by centrifugal force away from the center of the grinding table 18. Upon reaching the region of the circumference of the grinding table 18, the coal particles are picked up by the air flowing upwardly from beneath the grinding table 18 and are carried away therewith. Thereafter, the stream of air with the coal particles entrained therein follows a tortuous path through the interior of the bowl mill 10. Moreover, in the course of following this tortuous path the larger of the coal particles are caused to be separated from the air stream in which they are entrained and are made to return to the surface of the grinding table 18 whereupon they undergo further pulverization. The lighter of the coal particles, on the other hand, continue to be carried along in the air stream. Ultimately, the combined stream of air and those coal particles that remain entrained therein flows to the classifier 34 to which reference has previously been had hereinbefore.

The classifier 34, in accord with conventional practice and in a manner which is well known to those skilled in this art, operates to effect a further sorting of the coal particles that remain in the air stream. Namely, those particles of pulverized coal, which are of the desired particle size, pass through classifier 34 and along with the air are discharged therefrom and thereby from the bowl mill 10. On the other hand, those coal particles which in size are larger than desired, are returned to the surface of the grinding table 18 whereupon they undergo additional pulverization. Thereafter, these coal particles are subjected to a repeat of the process described above. That is, the particles are thrown outwardly of the grinding table 18, are picked up by the air exiting from beneath the grinding table 18, are carried along with the air through the yet to be described tortuous path that is provided therefor through the interior of the bowl mill 10, as the air stream follows the aforesaid tortuous path the heavier particles drop back onto the grinding table 18, the lighter particles though continue to be carried along with the air to the classifier 34, those particles which are of the proper size pass through the classifier 34 and exit from the bowl mill 10.

Figure 2:
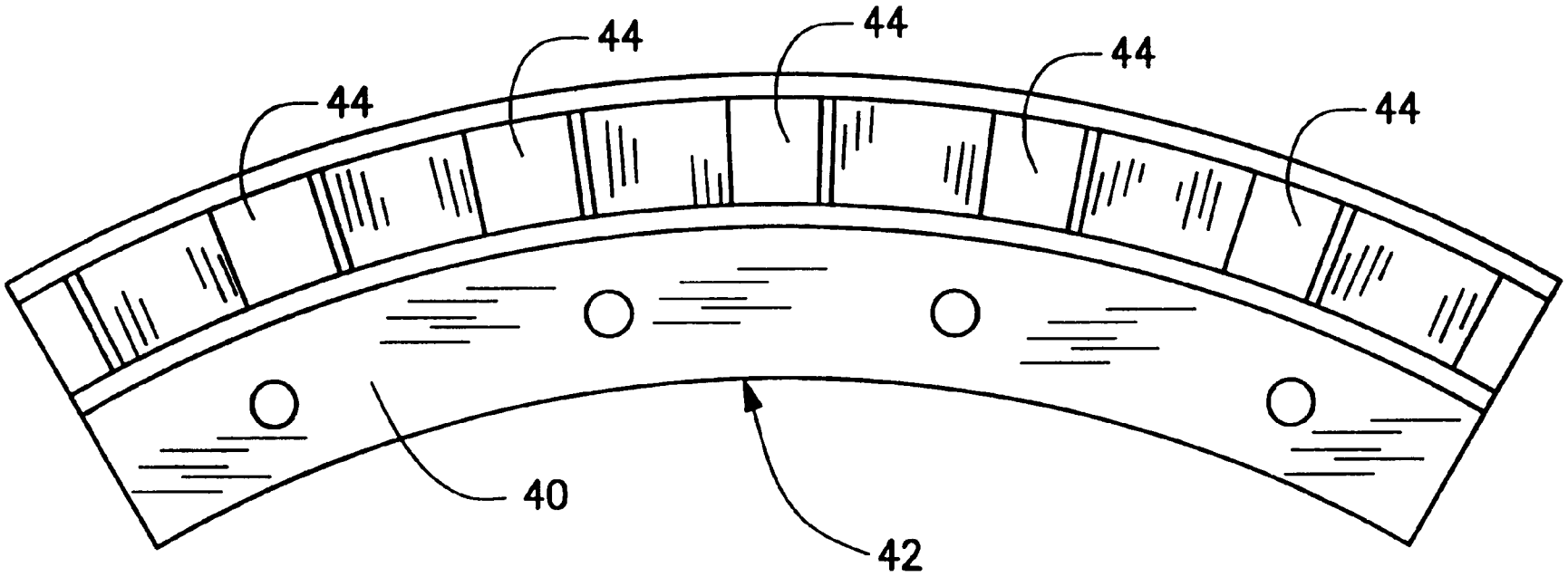
FIG. 2 is a top plan view of a portion of the vane wheel assembly of the pulverizer bowl mill shown in FIG. 1.

The present invention provides an arrangement 38 for securing the vane wheel assembly 12 to grinding table 16 of the bowl mill 10. Further details of the vane wheel assembly 12 will now be provided with reference to FIG. 2, which is a top plan view of one circumferential sector 40 of a channel member 42 of the vane wheel assembly and FIGS. 3A and 3B, which illustrate one variation of the preferred embodiment of the arrangement 38 for securing the vane wheel assembly 12 to the bowl mill 10. As seen in FIG. 2, the channel member 42 is mounted in supported relation by the arrangement 38 on the rotatable grinding table 18 of the bowl mill 10, in a manner to be described in more detail below.

The channel member 42 is operable to cause the air flowing in surrounding relation to the grinding table 18 to flow at a preestablished specified velocity therethrough in an upwardly direction as seen with reference to FIG. 1. This has the effect, as noted previously, of causing the pulverized material, which is thrown outwardly of the grinding table 18 under the influence of centrifugal force, to become entrained in the flow of air that is exiting from the channel member 42.

As seen in FIG. 2, the channel member 42 defines a plurality of individual channel passages, each of which is designated as a channel passage 44. The channel member 42 preferably encompasses six such channel passages 44 in each sixty (60) degrees circumferential sector of the circumference of the grinding table 16, thus making for a total of thirty-six (36) such channel passages 44, six per sixty (60) degree sector, located around the entirety of the circumference of the grinding table 18. It is noted, however, that the channel passages 44 may be formed by any other suitable circumferential sector arrangement such as, for example, a circumferential sector arrangement comprising three (3) circumferential sectors of one hundred and twenty (120) degrees each and each such circumferential sector encompassing a total of twelve (12) channel passages 44. Alternatively, the channel passages 44 may be formed in a single three hundred and sixty (360) degree circumferential arrangement.

Figure 3A:
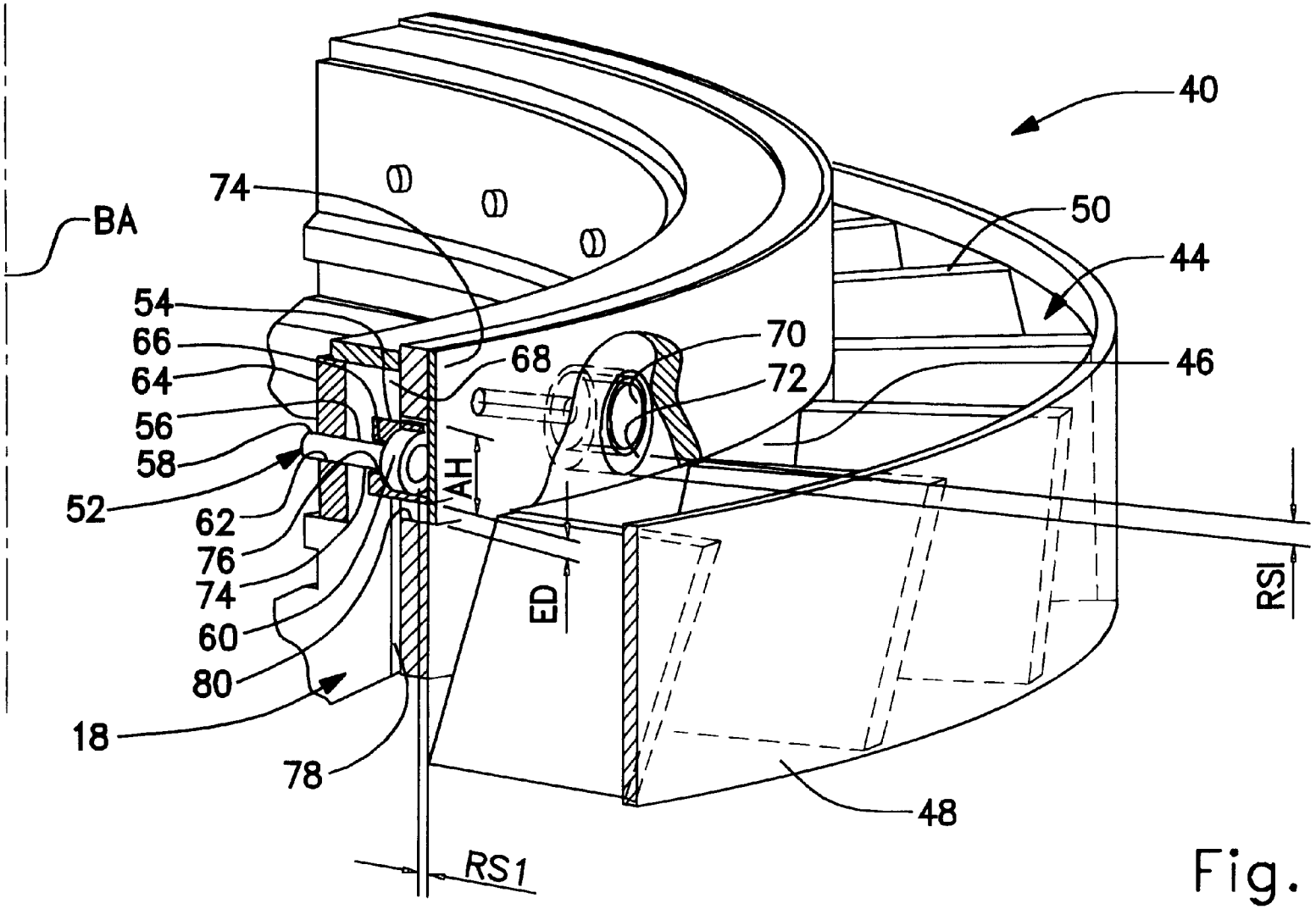
FIG. 3A is an enlarge perspective view of one variation of the arrangement of the present invention for securing a vane wheel assembly to a grinding table for rotation therewith, and showing the first and second relative movement means in one operational disposition.
Figure 3B:
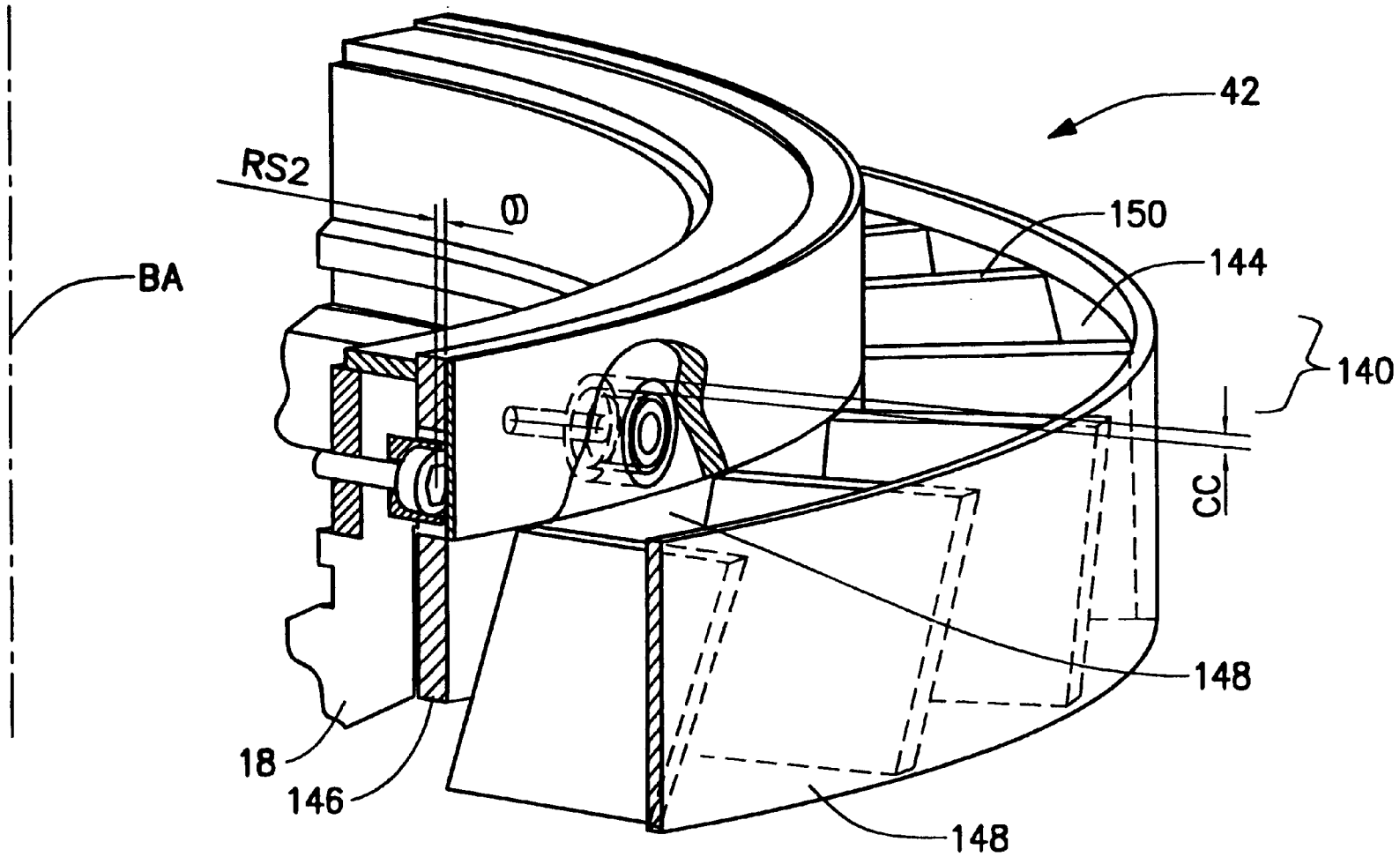
FIG. 3B is an enlarged perspective view of the one variation of the arrangement shown in FIG. 3A and showing the first and second relative movement means in a different operational disposition.

As seen in FIGS. 3A and 3B, which show a perspective view of a portion of one of the circumferential sectors forming the channel passages 44, the channel member 42 includes an inner shroud portion 46, an outer shroud portion 48, and a plurality of vanes 50. The inner shroud portion 46 is of a lesser radius measured relative to the bowl mill axis than the outer shroud portion 48 and the inner shroud portion 46 and the outer shroud portion 48 are fixedly interconnected to one another by the vanes 50. Each vane 50 includes an axial extent which may be planar, arcuate, or another geometric shape and one edge of the vane is compatibly shaped with respect to the inner shroud portion 46 and fixed thereto by, for example, welding, while the opposite edge of the vane in compatibly shaped with respect to the outer shroud portion 48 and fixed thereto by, for example, welding. The vanes 50 of each circumferential sector of the channel member 42 are spaced from one another in the circumferential direction such that each adjacent pair of the vanes 50 defines therebetween one of the channel passages 44.

The channel member 42 is secured to the grinding table 18 by the arrangement 38 which includes a first securement means securable with the bowl mill 10 and a second securement means securable with a shroud sub-assembly which, in the preferred embodiment, comprises the six inner shroud portions 46 and the six corresponding outer shroud portions 48. In the preferred embodiment, the first securement means and the second securement means cooperate together to retain each inner shroud portion 46 and its corresponding outer shroud portion 48 in a retained relationship with the bowl mill 10 for rotation of the vanes 50 with the bowl mill 10 during rotation of the bowl mill. The first securement means and the second securement means movably engage one another in a manner permitting free movement in a predetermined direction of at least a portion of the shroud sub-assembly relative to the bowl mill 10 while the shroud sub-assembly is in its retained relationship with the bowl mill. Preferably, the first securement means and the second securement means movably engage one another in a manner permitting free movement in a predetermined direction of each of the six circumferential sectors of the inner shroud portions 46 and the outer shroud portions 48.

The first securement means includes a plurality of pins 52 and a corresponding plurality of sleeves 56. Each pin is preferably formed with an elongate body portion 54 having, at one axial end thereof, a series of threads 58, and, at the opposite axial end thereof, a retaining head 60. The threads 58 are compatibly configured with a threaded tap bore 62 of which a plurality are formed at equal predetermined circumferential spacings from one another in a bull ring 64 mounted to the grinding table 18. A plurality of through bores 66 corresponding in number and location to the threaded tap bores 62 are formed in the circumferential outer surface 68 of the grinding table 18, each through bore 66 permitting passage therethrough of a respective one of the pins 52 for threaded engagement of the threads 58 of the pin with a respective one of the threaded tap bores 62. The bull ring 64 is an annular ring mounted to the grinding table 18 along an interior radius thereof interiorly of the circumferential surface 68 of the grinding table 18 on which the inner shroud portions 46 are mounted.

Each sleeve 56 has a cylindrical outer surface and an inner through bore 70 having a first radius selected in consideration of the radius of the elongate body portion 54 of a pin 52 to permit the elongate body portion 54 of the pin to pass therethrough and a second radius larger than the first radius and selected in consideration of the radius of the retaining head 60 of a pin 52 such that the retaining head is seated within the second radius portion of the inner through bore 70 of the sleeve when the elongate body portion 54 of the pin has been received through the first radius portion of the inner through bore 70. Each of the throughbores 66 formed in the circumferential surface 68 of the grinding table 18 is provided with an enlarged cylindrical portion extending radially inwardly from the outer circumferential surface 68 and sized with respect to the retaining head 60 of a pin 52 such that the radially inwardmost axial extent of the retaining head 60 of the respective pin 52 is received in the enlarged cylindrical portion of the throughbore 66 while the radially outermost axial extent of the retaining head 60, and the corresponding enlarged second radius portion of the sleeve 56 in which the retaining head is seated, both extend radially outwardly of the outer circumferential surface 68 of the grinding table 18.

The second securement means is preferably in the form of a means forming an aperture in the shroud sub-assembly. In the one variation of the preferred embodiment of the arrangement of the present invention shown in FIGS. 3A and 3B, the means forming an aperture in the shroud sub-assembly is preferably in the form of a plurality of aperture forming means each forming an aperture 72 in one of the inner shroud portions 46. The apertures 72 formed in the inner shroud portions 46 each extends completely radially through the respective inner shroud portion and is located and dimensioned with respect to a respective one set of the pins 52 and their corresponding sleeves 56 such that the respective sleeve 56 extends radially into the aperture 72 in the installed disposition of the respective inner shroud portion 46 on the grinding table 18.

As seen in FIG. 3A, each aperture 72 has a diameter AH which is dimensioned with respect to the diameter of a sleeve 56 in a relationship in which the height AH of the aperture 72, as measured relative to the axis of the bowl mill 10, is sufficiently relatively larger than the sleeve diameter so as to permit predetermined movement of the respective inner shroud portion 46 in which the aperture 72 is formed relative to the grinding table 18. For example, the height AH of the aperture 72 shown in FIG. 3A is greater than the diameter of a sleeve 56 by an excess dimension ED which is preferably equal to between about 100.5% to 103% of the sleeve diameter. The predetermined relative movement which is permitted by this arrangement preferably includes at least relative radial movement between the inner shroud portion 46 and the grinding table 18 and may also include axial and angular relative movement as well. In the one variation of the arrangement shown in FIG. 3A, each sleeve 56 is fixedly mounted with respect to the grinding table 18 and so the predetermined relative movement between each inner shroud portion 46 and the grinding table 18 is manifested as relative movement between the respective inner shroud portion 46 and the respective sleeve 56 received therein. Moreover, the aperture 72 may be formed as a cylindrical aperture such as the aperture shown in FIG. 3A which permits radial, axial, and angular movement of each inner shroud portion 46 relative to the sleeves 56.

Preferably, as shown in the one variation of the preferred embodiment of the arrangement illustrated in FIGS. 3A and 3B, each sleeve 56 received in a respective aperture 72 of an inner shroud portion 46 does not extend fully radially through the aperture but, instead extends to a radial spacing from the axis of the bowl mill 10 less than the radius of outer circumferential surface of the respective inner shroud portion 46, thereby permitting an annular facing ring portion 74 to be mounted on the outer circumferential surface of the inner shroud portion. These facing ring portions 74 completely cover the apertures 72 so as to reduce the passage of pulverized material into the apertures.

It can thus be appreciated that the first securement means, in the form of the pins 52 and the sleeves 56, and the second securement means, in the form of the means forming the apertures 72 in the inner shroud portions 46, movably engage one another in a manner permitting free movement in a predetermined direction of the inner shroud sub-assembly relative to the bowl mill 10 while the inner shroud sub-assembly is in its retained relationship with the bowl mill. FIG. 3A illustrates the one variation of the arrangement of the present invention in one pulverizer operational scenario in which the respective inner shroud portion 46 is disposed relative to the respective sleeves 56 on which it is supported such that a portion of the axially upper surface of each means forming an aperture 72 is engaged by a portion of the axially upper surface of a sleeve 56. Moreover, in this one pulverizer operational scenario, the outer end of each sleeve 56 is spaced radially inwardly from the respective facing ring portion 74 by an amount RS1, as measured along the sleeve axis. Turning now to FIG. 3B, this figure illustrates the one variation of the arrangement of the present invention in a second pulverizer operational scenario which may differ from the one pulverizer operational scenario in a number of respects such as, for example, a different temperature regime and/or a different instantaneous loading of pulverized material being channeled through the channel member 42. As seen in FIG. 3B, the respectively illustrated inner shroud portion 46 has moved relative to the grinding table 18 as shown by the fact that the portion of the upper axial surface of each means forming an aperture 72 is no longer in engagement with the respective sleeve 56 but, instead, there is a circumferential clearance CC around the entire circumference of the sleeve 56 and the corresponding aperture in which it is received. Additionally, respective inner shroud portion 46 has moved radially with respect to the grinding table 18 as shown by the radial spacing RS2 between the outer end of each sleeve 56 and the facing ring portion 74 which is greater than the radial spacing RS1 of the one pulverizer operational scenario shown in FIG. 3A.

Figure 4:
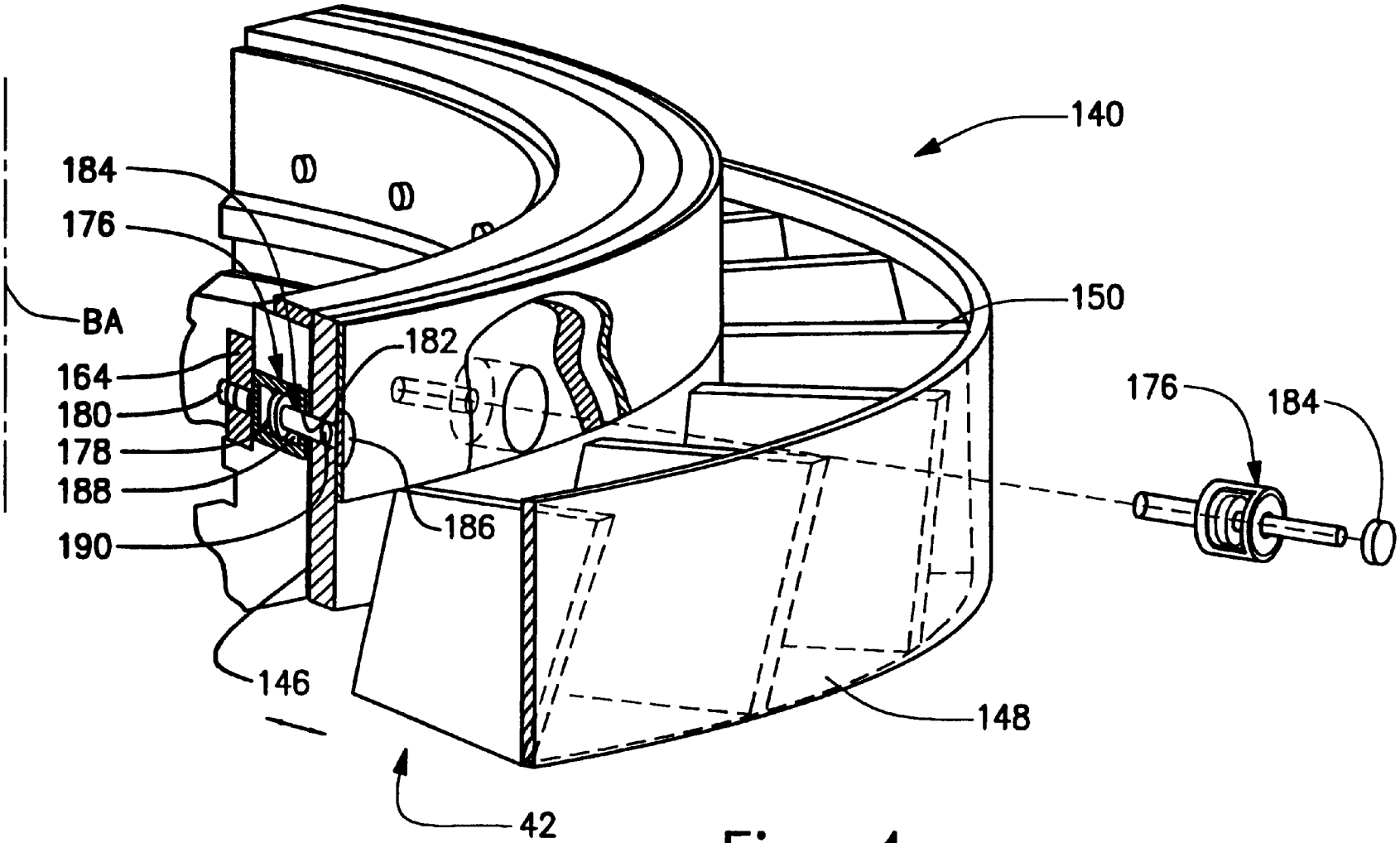
FIG. 4 is an enlarged perspective view of another variation of the arrangement of the present invention.

FIG. 4 illustrates another variation of the arrangement of the present invention and depicts a portion of one of the circumferential sectors forming the channel member 42 and a corresponding portion of the grinding table 18. For ease of reference, components illustrated in FIG. 4 are denominated with the one hundred ("100") series reference numbers of like components shown in the one variation of the arrangement of the present invention shown in FIGS. 3A and 3B. The channel member 44 includes an inner shroud portion 146, an outer shroud portion 148, and a plurality of vanes 150. The inner shroud portion 146 is of a lesser radius measured relative to the bowl mill axis than the outer shroud portion 148 and the inner shroud portion 146 and the outer shroud portion 148 are fixedly interconnected to one another by the vanes 150. Each vane 150 includes an axial extent which may be planar, arcuate, or another geometric shape and one edge of the vane is compatibly shaped with respect to the inner shroud portion 146 and fixed thereto by, for example, welding, while the opposite edge of the vane in compatibly shaped with respect to the outer shroud portion 148 and fixed thereto by, for example, welding. The vanes 150 of each circumferential sector 140 of the channel member 42 are spaced from one another in the circumferential direction such that each adjacent pair of the vanes 150 defines therebetween one of the channel passages 144.

The channel member 42 is secured to the grinding table 18 by an arrangement which includes a first securement means securable with the bowl mill and a second securement means securable with the shroud sub-assembly which, in the preferred embodiment, comprises the six inner shroud portions 146 and the six corresponding outer shroud portions 148. A first securement means is secured to the grinding table 18 and includes a cylinder member 176 having a cylinder 178, a threaded bolt end 180 at one axial end of the cylinder 178, and a throughbore 182 at the opposite axial end of the cylinder 178. The threaded bolt end 180 is threadably secured in a corresponding threaded bore in the bull ring 164 to thereby fixedly mounted the first securement means to the grinding ring 18.

A second securement means includes a pin 184 having a threaded axial end 186 and, at is opposite axial end, an enlarged radius head 188. The threaded axial end 186 is adapted to threadingly engage a threaded bore 190 in the inner shroud portion 146 so as to fixedly mount the pin 184 to the inner shroud portion. The enlarged radius head 188 of the pin 184 is disposed in the cylinder 178 such that the pin 184 can move radially relative to the first securement means, as viewed with respect to the bowl mill axis BA. As the inner shroud portion 146 expands radially outwardly relative to the grinding table 18, the enlarged radius head 188 of the pin 184 moves within the cylinder 178 in a direction toward the throughbore 182 of the first securement means. Thus, in the another variation of the arrangement of the present invention shown in FIG. 4, the first securement means and the second securement means cooperate together to retain the shroud sub-assembly in a retained relationship with the bowl mill 10 for rotation of the vanes 150 with the bowl mill during rotation of the bowl mill and the first securement means and the second securement means movably engage one another in a manner permitting free movement in a predetermined direction of the shroud sub-assembly relative to the bowl mill while the shroud sub-assembly is in its retained relationship with the bowl mill.

We claim:

1. In a bowl mill of a pulverizer, the bowl mill having a substantially closed body portion, a rotatable grinding table, and at least one grinding roll mounted within the bowl mill so as to coact with the rotatable grinding table, a vane wheel assembly comprising:

a shroud sub-assembly;

a plurality of vanes mounted to the shroud sub-assembly at circumferential spacings from one another;

first securement means securable with the grinding table; and second securement means securable with the shroud sub-assembly;

the first securement means and the second securement means cooperating together to retain the shroud sub-assembly in a retained relationship with the grinding table for rotation of the vanes therewith and the first securement means and the second securement means movably engaging one another in a manner permitting free movement in a predetermined direction of at least a portion of the shroud sub-assembly relative to the grinding table while the shroud sub-assembly is in its retained relationship with the grinding table.

2. In a bowl mill of a pulverizer, a vane wheel assembly according to claim 1 wherein the first securement means is a pin means and the second securement means is a means forming an aperture in the shroud sub-assembly, the aperture for receiving therethrough the guide means and being configured with respect to the cross section of the guide means such that a selected dimension of the aperture, as measured perpendicular to the longitudinal axis of the bolt of the guide means, is at least about 100.5 percent (%) to about 103 percent (%) greater than the corresponding dimension of the guide means as measured at the aperture.

3. In a bowl mill of a pulverizer, a vane wheel assembly according to claim 2 wherein the shroud sub-assembly is composed of a plurality of circumferential portions collectively forming a circle.

4. In a bowl mill of a pulverizer, a vane assembly according to claim 3 wherein each circumferential portion includes an inner shroud portion, an outer shroud portion and at least one vane secured to and between the inner and outer shroud portions.

* * * * *